United States Patent [19]

Glaesel

[11] 4,077,696

[45] Mar. 7, 1978

[54] ELECTRICAL TERMINAL

[75] Inventor: Gottfried Glaesel, Minusio, Switzerland

[73] Assignee: Hego Electric GmbH, Glarus, Switzerland

[21] Appl. No.: 680,410

[22] Filed: Apr. 26, 1976

[51] Int. Cl.[2] ..... H01R 11/26

[52] U.S. Cl. ..... 339/266 R; 24/132 WL

[58] Field of Search ..... 339/95, 97, 98, 266, 339/270, 274, 75 MP; 24/132, 248 SA, 248 A, 248 E, 249 LS, 249 LL

[56] References Cited

U.S. PATENT DOCUMENTS

| | | | |
|---|---|---|---|
| 2,451,466 | 10/1948 | Bentley | 339/266 R |
| 2,461,135 | 2/1949 | Bentley | 339/266 R |
| 3,309,645 | 3/1967 | Noschese | 339/98 |
| 3,437,979 | 4/1969 | Beaudion | 339/266 R |
| 3,812,453 | 5/1974 | Kiessling | 339/266 R |

FOREIGN PATENT DOCUMENTS

| | | | |
|---|---|---|---|
| 520,245 | 6/1963 | Belgium | 339/266 R |
| 22,981 | 9/1969 | Japan | 339/75 MP |
| 1,074,972 | 7/1967 | United Kingdom | 24/249 LS |

*Primary Examiner*—Joseph H. McGlynn
*Attorney, Agent, or Firm*—Pollock, Vande Sande & Priddy

[57] ABSTRACT

An electrical terminal comprises a U-section body, a clamping screw substantially parallel to the base of the U, and a generally L-shaped clamping member loosely located and pivotable in the body and having one arm acted on by the clamping screw for pivoting the clamping member to clamp an inserted conductor.

4 Claims, 6 Drawing Figures

ELECTRICAL TERMINAL

This invention relates to electrical clamping terminals.

Screw-clamping terminals comprising a sleeve to receive a conductor, and a clamping screw extending transversely to the conductor, are well known. However, these have the disadvantage that access to the terminal from at least two different sides is necessary, for insertion of the conductor and operation of the clamping screw.

Clamping terminals have also been proposed in which it is possible to insert the conductor substantially parallel to the clamping screw, for example in British Pat. No. 1,382,750. In the latter, a clamping member has an aperture traversed by the shank of the clamping screw so that the head of the screw causes pivoting of the clamping member. A disadvantage of this is that assembly of the terminal is relatively tedious because the clamping member has to be fitted onto the clamping screw, the provision of a hole in the clamping member represents an additional manufacturing step which increases cost, and the hole weakens the clamping member. Other known terminals in which a conductor can be inserted substantially parallel to the clamping screw use wedges, cams and other relatively complex constructions to provide the clamping action.

An object of the invention is to provide an electrical clamping terminal for receiving a conductor substantially parallel to the clamping screw, having a cheaper, simple and robust construction.

The present invention resides in an electrical terminal comprising a U-section body of bent sheet metal and having a transverse member extending transversely to the limbs and base of the U, a clamping screw threaded in the said transverse member and extending generally parallel to the base of the U and between the limbs thereof, and a generally L-shaped pivotable clamping member located in the body between the limbs thereof and having a first arm laterally spaced from a clamping surface in the body generally parallel to the screw and a second arm disposed to be engaged by the screw tip, the body providing access for insertion of a conductor between the first arm and the clamping surface whereby on tightening of the clamping screw the inserted conductor can be clamped in the body.

The invention also resides in a clamping device for connecting external stripped and/or insulated electrical conductors parallel to the axis of the terminal screw and comprising a terminal member which is bent from a sheet metal strip into a U-shaped closed member and a thrust-transmitting element which can be ajusted by means of the terminal screw, the thrust-transmitting element being constructed as a loose clamping bar which is merely guided by the terminal member and has one end on which a terminal screw acts, operation of which screw causes the clamping bar to be displaced in the direction of the conductor entry passage about a pivoting point which is provided in a recess of the terminal member or loosely on any desired support point of the interior of the terminal member, so that the inserted conductor is clamped between the inner edge of the terminal member and the clamping bar.

Since there is no longer any need to provide a screw-receiving hole in the clamping member, the manufacture of the latter can be carried out by a simple stamping and/or pressing operation, its strength is not impaired, and assembly of the terminal is simplified.

The transverse member may be integral with at least one limb of the U, or may be a non-rotatable nut mounted between the limbs of the U.

The first arm of the clamping member may be loosely pivotable on the transverse member. Alternatively, an intermediate region of the clamping member may rest loosely on and pivot on a further transverse member. In a further possible construction, the first arm of the clamping member may have a lateral pivot projection which rests loosely against an edge of a limb of the U.

A fixed conductor may be provided between the first arm of the clamping member and the clamping surface. In this case, only the fixed conductor need be of highly conductive metal, and the rest of the terminal can be made for example of sheet or strip steel.

The first arm of the clamping member, and/or the fixed conductor if provided, may have at least one sharp point or edge for penetrating insulation of an inserted insulated conductor, and/or a rough surface (provided for example by milling or by ribs or grooves) for gripping an inserted conductor.

Four embodiments of the invention are shown in the accompanying drawings, in which.

Figure 1:
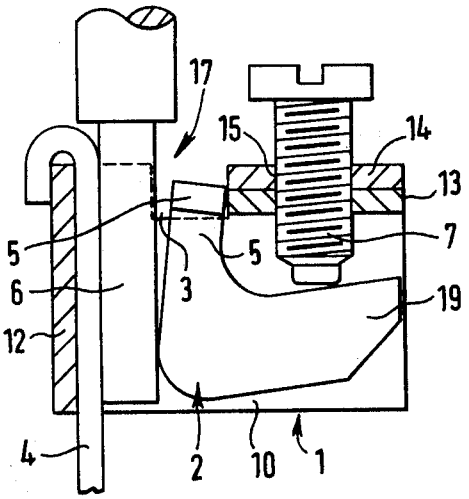
FIGS. 1 to 3 are respectively sectional views of three terminals embodying the invention.
Figure 6:
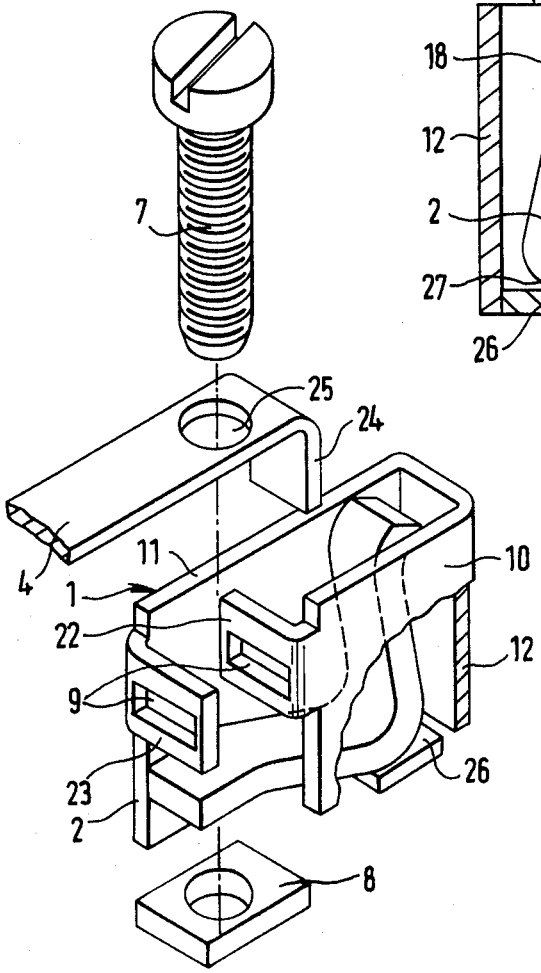
FIG. 6 is an exploded perspective view of the terminal shown in FIG. 5.

The terminal shown in FIG. 1 has a clamping body 1 formed of bent sheet metal strip, substantially identical to that shown in FIGS. 1 and 6 of British patent specification No. 1,382,750. This body is of U-shaped cross section comprising two spaced parallel side walls 10, 11 forming the limbs of the U, interconnecting by a third wall 12 forming the base of the U, and a pair of overlapping transverse members 13, 14 respectively integral with the side walls 10, 11, perpendicular to the walls 10, 11 and 12 and containing a screw-threaded aperture 15 in which a clamping screw 7 is threaded. Alternatively, the transverse members 13, 14 may be replaced by a separate plate secured to the side walls. These members terminate short of the wall 12 to form an aperture 17 for insertion of an electrical conductor 6 parallel to the wall 12 and the screw 7. A fixed conductor strip 4 is placed against the inner surface of the wall 12 and extends to a further terminal, for example a further clamping terminal, or a solder tap, plug pin or wire-wrap pin integral with the conductor 4 itself.

The edge of the side wall 10 adjacent to the transverse member 13 contains a notch 3.

Between the side walls 10, 11 is an L-shaped clamping member 2 comprising a first arm 18 extending between and generally parallel to the screw 7 and wall 12 and spaced from the latter, and a second arm 19 adjacent to the tip of the clamping screw 7. The end of the first arm 18 has a lateral pivot projection 5 which rests on the edge of the wall 10 in the recess or notch 3, so that the clamping member can pivot about this projection. This clamping member can be made by a simple stamping and bending operation, as can the body of the terminal.

In use, the conductor 6 is inserted into the terminal body between the conductor 4 and the limb 18 of the clamping member 2, and the screw 7 is tightened so as to pivot the clamping member about its projection 5 so that the clamping member moves towards the wall 12, thereby clamping the conductor 6.

If desired, the the end of the arm 18 of the clamping member may be T-shaped, to provide a pair of oppositely directed pivot projections for engaging respective recesses in both side walls of the body.

Figure 2:
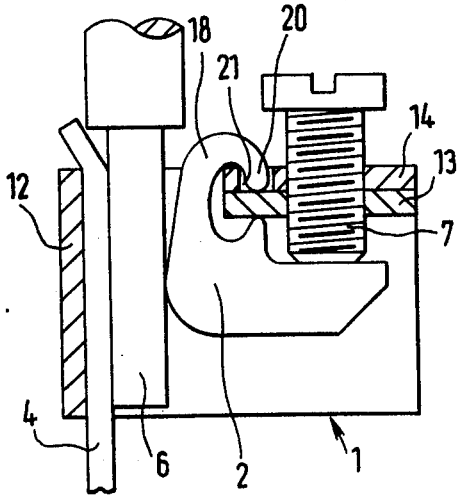

The terminal shown in FIG. 2 has a substantially identical body 1 but in this case the limb 18 of the clamping member 2 is loosely pivoted on the transverse member 13 and is retained by an integral hook 20 fitting an aperture 21 in the transverse member 14, to permit the pivoting of the clamping member 2 on rotation of the clamping screw 7. The clamping member shown in FIG. 2 is manufactured by a simple stamping or punching operation.

Figure 3:
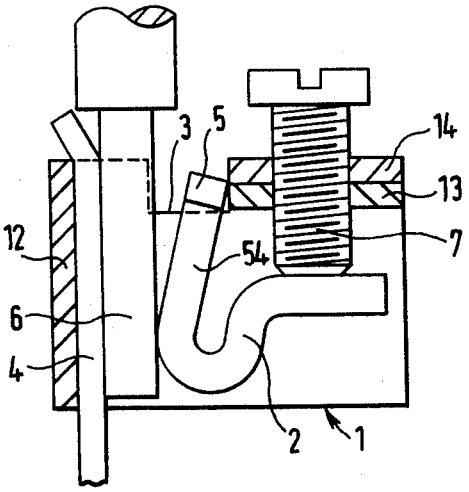
Figure 4:
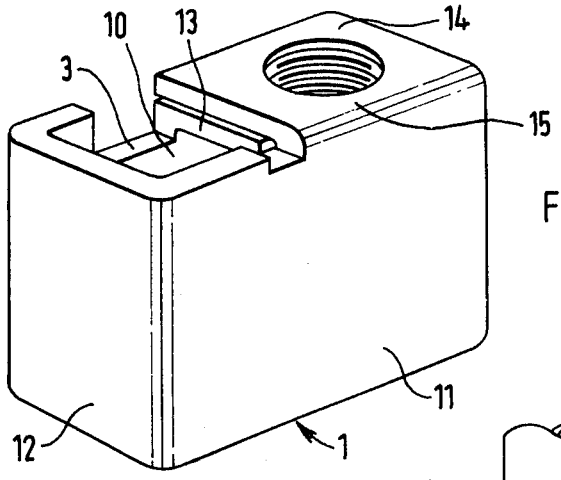
FIG. 4 is a perspective view of the body of such a terminal.

The body of the terminal shown in FIG. 3 is identical to that of FIG. 1, but in this case the clamping member 2 is a bent metal bar, again provided with a lateral pivot projection 5 on the end of its arm 18. The clamping member is provided with a double bend for added strength.

Figure 5:
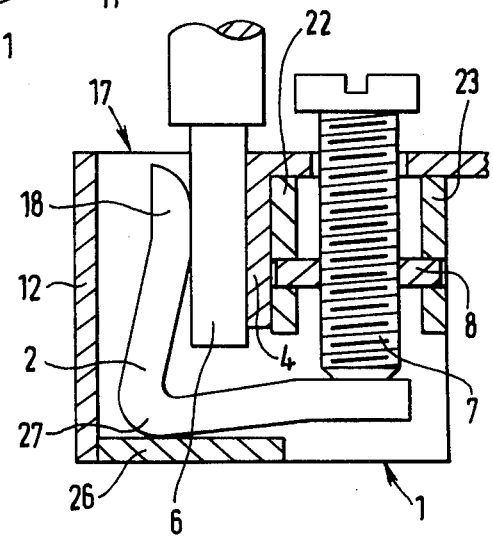
FIG. 5 is a view corresponding to FIG. 1, of a fourth terminal embodying the invention.

FIGS. 5 and 6 show a terminal in which the body 1 is again of U-shaped cross section but in this case the transverse member in which the clamping screw 7 is threaded is a nut 8 located in apertures 9 of transverse lugs 22, 23 integral with the side walls 10, 11. Thus the nut can neither rotate nor move axially in the body. A fixed conductor 4 extends across the upper edges of the lugs 22, 23 and has a bent end portion 24 which rests against the surface of the lug 22 facing the wall 12 of the body. The clamping screw 7 extends through a hole 25 in the conductor 4, holding the latter captive.

A further transverse member 26 integral with the side wall 11 (or with the wall 10 or 12) extends perpendicular to the walls 10, 11 and 12 and faces the conductor entry 17.

The clamping member 2 is a simple L-shaped bent metal bar of which the intermediate region of its angle 27 rests loosely on the transverse member 26. In use, the conductor 6 is inserted between the arm 18 of the clamping member and the conductor 4, and the screw 7 is tightened so that the arm 18 clamps the conductor 6.

The terminals illustrated will in practice be disposed in insulating housings, for example of the well known clip-on type, for mounting on flanged channel-section rails.

Such an insulating body may contain a pair of terminals, for example a pair of the terminals shown in FIGS. 5 and 6, interconnected by a common fixed conductor 4, or a pair of terminals the bodies of which are formed from a single piece of metal sheet or strip to provide two (or more) conductor entry apertures or clamping positions. The terminals may be provided with means for making cross-connections to adjacent terminals of a row of terminals, for example as in the aforementioned clip-on terminal blocks.

I claim:

1. An electrical terminal comprising a U-section body of bent sheet metal and having a transverse member extending transversely to the limbs and base of the U, a clamping screw having a screw tip threaded in the said transverse member and extending generally parallel to the base of the U and between the limbs thereof, and a generally L-shaped claimping member loosely located in the body between the limbs thereof and having a first arm laterally spaced from a clamping surface in the body generally parallel to the screw and a second arm disposed to be engaged by the screw tip, the said first arm having at its end an external surface tiltably engaging a portion of the body, the body providing access for insertion of a conductor between the said first arm and the clamping surface whereby on tightening of the clamping screw the inserted conductor can be clamped in the body.

2. A terminal according to claim 1, wherein a fixed conductor is provided between the said first arm and clamping surface.

3. A terminal according to claim 1, wherein the first arm of the clamping member is loosely pivotable on the transverse member.

4. A terminal according to claim 1, wherein the said external surface on the said first arm of the clamping member is a lateral pivot projection resting loosely against an edge of a limb of the U.

* * * * *